United States Patent [19]

Ryan

[11] 4,216,075

[45] Aug. 5, 1980

[54] COMBINATION DEWAXING PROCESS

[76] Inventor: Douglas G. Ryan, 145 Andrea Dr., Rockaway, N.J. 07866

[21] Appl. No.: 974,070

[22] Filed: Dec. 28, 1978

[51] Int. Cl.[2] ..... C10G 43/08

[52] U.S. Cl. ..... 208/35; 208/33; 208/38

[58] Field of Search ..... 208/33, 35, 38

[56] References Cited

U.S. PATENT DOCUMENTS

| | | | |
|---|---|---|---|
| 2,202,542 | 5/1940 | Voorhees | 208/35 |
| 2,347,809 | 5/1944 | Brandt | 208/35 |
| 3,549,513 | 12/1970 | Woodle | 208/33 |
| 3,658,688 | 4/1972 | Biribauer et al. | 208/35 |
| 3,720,599 | 3/1973 | Gould | 208/33 |
| 3,773,650 | 11/1973 | Hislop et al. | 208/33 |

*Primary Examiner*—Herbert Levine

*Attorney, Agent, or Firm*—E. M. Corcoran; J. J. Allocca

[57] ABSTRACT

A continuous, combination ketone-autorefrigerant solvent dewaxing process is disclosed wherein a waxy oil is partially solvent dewaxed to within from about 30° to 110° F. of the final wax filtration temperature in a first chilling zone, preferably comprising a plurality of agitated stages in the presence of a ketone dewaxing solvent to form a slurry containing solid wax particles, partially dewaxed oil and solvent. This ketone-containing slurry is passed to a second chilling zone, which is an autorefrigerant chilling zone, preferably employing liquid propylene operates on a continuous basis, and comprises a vertical, multi-staged tower, operating at constant pressure, wherein additional wax is precipitated from the slurry. In the second chilling zone the slurry is chilled down to the wax filtration temperature by stagewise contact with liquid propylene which is injected into a plurality of said stages and evaporated therein so as to cool the waxy slurry at an average rate of between about 0.1° to 20° F. per minute with an average temperature drop across each stage of between about 2° and 20° F. Some of the propylene remains in the oil which serves to further dilute and reduce the viscosity of the slurry. The dewaxed oil-containing slurry may then be fed directly to wax filters without having to pass through scraped-surface chillers and filter feed drum.

17 Claims, 4 Drawing Figures

COMBINATION DEWAXING PROCESS

BACKGROUND OF THE INVENTION

1. Field of the Invention

This invention relates to a process for solvent dewaxing waxy oils. More particularly, this invention relates to a continuous, combination non-autorefrigerant-/autorefrigerant solvent dewaxing process employing two chilling zones wherein a majority of the wax is precipitated in a first chilling zone in the presence of a non-autorefrigerant dewaxing solvent to form a waxy slurry which is then fed directly to a second chilling zone comprising a vertical, staged tower operating continuously at essentially constant pressure. In the second chilling zone the slurry is cooled down to wax filtration temperature and additional wax is precipitated from the oil by contact with a liquid autorefrigerant injected into a plurality of said stages, said liquid autorefrigerant evaporating in each of said stages so as to maintain an average slurry cooling rate of from 0.1° to 20° F. per minute and an average temperature drop per stage of from about 2° to 20° F. The dewaxed oil-containing slurry is then fed to wax filters. This process if particularly useful for dewaxing wax-containing lubricating oil fractions and the like.

2. Description of the Prior Art

It is well known in the art to dewax wax-containing hydrocarbon oils, particularly the lube oil fractions of petroleum oil, in order to remove at least a portion of the wax therefrom to obtain a dewaxed oil of reduced cloud and pour points. The most common method of removing the wax or waxy constituents from waxy hydrocarbon oils is via the use of various solvent dewaxing processes. In solvent dewaxing processes the temperature of the wax-containing oil is lowered sufficiently to precipitate the wax therefrom as solid crystals of wax. At the same time, solvents are added to the waxy oil in order to improve the fluidity and reduce the viscosity thereof so that various filtration or centrifugation processes can be used to separate the solid particles of the wax from the dewaxed oil. Strong wax antisolvents (weak oil solvents) such as MEK are often added to decrease wax solubility in the oil/solvent mixture while strong oil solvents (weak wax antisolvents) such as MIBK or toluene are used to modify the solubility characteristics of the solvent so as to allow wax precipitation, while at the same time avoiding oil immiscibility at wax separation temperatures. Solvent dewaxing processes produce what is known as a pour-filter temperature spread. This is the temperature differential between the wax filtering temperature and the pour point of the dewaxed oil. This pour-filter temperature spread is greater when more non-polar hydrocarbon solvents are used than with more polar solvents such as ketones. Thus, an autorefrigerant dewaxing process employing propane can produce a pour-filter spread of 40° F., which means that the wax filtration must be done at −40° F. in order to produce a dewaxed oil having a pour point of 0° F. When ketones or mixtures of ketone and aromatic solvents are used, the pour-filter spread may range from 0° F. to 20° F. depending on the oil and solvent used.

Both ketone and autorefrigerant dewaxing processes have certain advantages and disadvantages. Thus, although ketone dewaxing processes result in a lower pour-filter spread at the wax filtration temperature and although larger wax crystals can be grown in a ketone environment than in an autorefrigerant environment without dewaxing aid, ketones are relatively nonvolatile compared to autorefrigerants, and, therefore, chilling of the solvent/oil mixture must be accomplished by either indirect means or by mixing cold ketone solvent with the oil. In the latter case, practical considerations limit the amount and temperature of cold ketone solvent that can be added and the temperature to which the solvent/oil mixture can be cooled. Therefore, some means of indirectly chilling the waxy slurry following the addition of solvent is required in all ketone dewaxing processes in order to bring the slurry down to the required wax filtration temperature. The most common method of indirect chilling is via the use of scraped surface chillers which are expensive and difficult to maintain. Also, the scraped surface chillers tend to damage the wax crystals by the shearing action of the scraper blades.

Conversely, wax crystals grown in an autorefrigerant environment, such as propane or propylene, are generally small which necessitates the use of costly dewaxing aids in order to achieve good filtration rates, although evaporation of the autorefrigerant enables one to reach the wax filtration temperature without the necessity of employing scraped-surface chillers or indirect heat exchangers following the solvent dewaxing operation. Additionally, it has been found necessary to employ batch chilling in autorefrigerant dewaxing processes in order to allow a gradual reduction in pressure. This prevents sudden flashing of the autorefrigerant at the point of pressure release, thereby avoiding sudden large temperature drops of the oil slurry (shock chilling), which would result in even smaller wax crystals and concomitant slower filter rates of the wax from the dewaxed oil.

In some ketone solvent dewaxing processes, the waxy oil and solvent, at a temperature above the cloud point of the oil, are mixed before being cooled. This solution is then cooled at a uniform, slow rate under conditions which avoid agitation of the solution as the wax precipitates out. In another method, ketone dewaxing solvent is added to the oil at several points along a chilling apparatus, but the waxy oil is first chilled without solvent until some wax crystallization has occurred and the mixture has thickened considerably, after which a first increment of solvent, at the temperature of the oil, is introduced in order to maintain fluidity. Cooling continues, more wax is precipitated out and a second increment of solvent, at the temperature of the mixture, is added to maintain fluidity. This process is repeated until a temperature typically ranging from about 30° F. to 60° F. is reached, at which point an additional amount of solvent at the same temperature as the mixture is added in order to reduce the viscosity of the mixture which is further chilled in scraped-surface chillers to the desired filtration temperature. In these processes, if the solvent is introduced at a temperature lower than that of the oil or oil/solvent mixture, shock chilling occurs resulting in the formation of small and-/or acicula shaped wax crystals with attendant poor filter rate.

It is now well known that the adverse shock chilling effect can be overcome by introducing the waxy oil into an elongated, staged cooling zone or tower at a temperature above its cloud point and incrementally introducing cold dewaxing solvent into said zone, along a plurality of points or stages therein, while maintaining a high degree of agitation in said stages, so as to effect substantially instantaneous mixing of the solvent and wax/oil mixture as they progress through said zone. The basic concept of this commercially successful process is disclosed in U.S. Pat. No. 3,773,650, the disclosures of which are incorporated herein by reference and shall hereinafter be referred to as DILCHILL* dewaxing process.

*Registered service mark of Exxon Research and Engineering Co.

Commercially successful processes employing autorefrigerative cooling, wherein the waxy oil is mixed with a liquid autorefrigerant which is permitted to evaporate thereby cooling the oil by the latent heat of evaporation, are batch or semi-batch operations. This mixture of liquid autorefrigerant and oil are introduced into an expansion chamber wherein the pressure is slowly reduced to achieve controlled evaporation of the autorefrigerant and controlled cooling of the oil, thus avoiding the shock chilling which would result if the autorefrigerant were allowed to flash off. However, batch processes are cumbersome, difficult to operate and energy inefficient.

A number of attempts have been made to develop a continuous autorefrigerant process for dewaxing oils, including combinations of ketone/autorefrigerant processes. Thus, U.S. Pat. No. 3,549,513 discloses an autorefrigerative batch dewaxing process that is described as continuous but which really operates via the sequential use of a multiple number of batch chillers or expansion chambers. Waxy oil is diluted with an aromatic/ketone solvent mixture and with liquid autorefrigerant and cooling is achieved by controlled evaporation of the autorefrigerant by reducing the pressure in each batch chamber in a manner such that the autorefrigerant evaporates at a controlled rate. U.S. Pat. No. 3,658,688 discloses an autorefrigerant dewaxing process wherein a portion of the wax is precipitated from the oil in a DILCHILL dewaxing tower wherein the cooling occurs by the injection of cold autorefrigerant into the tower to produce a waxy slurry, followed by autorefrigerative cooling of the slurry in batch chillers. U.S. Pat. No. 2,202,542 suggests a continuous autorefrigerant dewaxing process wherein a waxy oil above its cloud point is premixed with warm, liquid propane. This mixture is introduced into a multi-staged cooling tower and liquid $CO_2$ is injected into each stage out of direct contact with the oil. This patent emphasizes the point that the liquid $CO_2$ must be introduced into each stage out of direct contact with the oil in the tower in order to avoid shock chilling. However, this is impractical because the vapor loads on the tower would be far in excess of what could be accommodated in a reasonably sized commercial tower. Also, refrigeration requirements are three times those normally needed and conditions for nucleation and growth of wax crystals are poor. U.S. Pat. No. 3,720,599 discloses a continuous process for dewaxing a waxy petroleum oil stock wherein the oil is premixed with acetone. This mixture is then introduced into a horizontal, elongated chilling vessel containing a plurality of stages operating at different pressures, with the pressure in each stage controlled by a back pressure regulator on each stage. Liquid autorefrigerant is introduced into the stages along the length of the chilling vessel while maintaining a high degree of agitation therein to avoid shock chilling. The autorefrigerant is partially evaporated in each stage, with the amount of evaporation being controlled by the pressure in each stage. Unfortunately, there are problems which currently preclude commercialization of this process, not the least of which is a practical, efficient way of getting the slurry to flow from stage to stage without plugging up the entire apparatus with wax or without multiple transfer pumps which would be expensive and would also tend to destroy the wax crystal structure. Another disadvantage entails the impracticality of providing separately driven agitators for each stage and the mechanical difficulties associated with a common horizontal drive shaft. Additionally, U.S. Pat. No. 3,720,599 provides for the nucleation and initial growth of wax to occur in the presence of substantial amounts (i.e., >25%) of autorefrigerant solvent, which, in the absence of dewaxing aid, has been found to produce wax crystals inferior to those produced when nucleation occurs by chilling in the presence of ketones or ketone/aromatic solvents followed by autorefrigeration. For example, when mixtures of ketone and high percentages (>40%) of propylene were used in the DILCHILL dewaxing process, a distillate oil/wax slurry was produced which filtered very poorly.

It would be an improvement to the art if one could combine both ketone and autorefrigerant solvent dewaxing processes into a continuous process and in such a manner so as to carefully form the wax nuclei and begin crystal growth in a substantially non-autorefrigerant solvent environment such as ketone, to achieve large, stable, spherical crystals without the use of dewaxing aid and then further precipitate additional wax without destroying the spheres via direct contact with an evaporating autorefrigerant, thereby avoiding the need for scraped surface chillers following the ketone dewaxing step.

SUMMARY OF THE INVENTION

What has now been discovered is a continuous, combination non-autorefrigerant/autorefrigerant process for solvent dewaxing waxy oils which comprises the steps of:

(a) passing the waxy oil, at a temperature above its cloud point, into a first chilling zone wherein a portion of the wax is precipitated from the oil by cooling same in the presence of a non-autorefrigerant dewaxing solvent to form a slurry of oil, solvent and solid particles of wax;

(b) passing the slurry from the first chilling zone to a second chilling zone which comprises a vertical, multi-staged tower operating at a constant pressure wherein each stage contains a liquid space and a vapor space above the liquid space, each of said vapor spaces also containing means for removal of autorefrigerant vapor therefrom;

(c) cooling said slurry produced in said first chilling zone down to wax filtration temperature and precipitating additional wax therefrom in said second chilling zone by contacting same in said second zone with a liquid autorefrigerant which is introduced under flow rate control conditions into a plurality of the stages in said second zone and allowed to evaporate therein so as to achieve an average cooling rate of the slurry in said zone ranging from between about 0.1° to 20° F. per minute with an average temperature drop across each stage into which said liquid autorefrigerant is introduced and evaporated ranging from between about 2° to 20° F. and wherein the evaporated autorefrigerant is removed from each of said stages into which said liquid autorefrigerant was injected in a manner such that the autorefrigerant vapor formed in any given stage does not pass through the slurry on all the stages in the tower above said stage; and (d) separating the wax from the slurry to obtain wax and a dewaxed oil solution.

The "cloud point" of the oil is defined as a temperature at which a cloud or haze of wax crystals first appears when an oil is cooled under prescribed conditions (ASTM D-2500-66 procedure). "Predilution", as the term is used herein, refers to the mixing of solvent and oil prior to cooling the oil to a temperature below its depressed cloud point and comprises, in one embodiment of this invention, prediluting a waxy oil with at least about 0.1 volumes of an autorefrigerative predilution solvent per volume of oil stock or at least 0.5 volumes of a non-autorefrigerative predilution solvent per volume of oil stock resulting in the depression of the cloud point of the oil stock. If predilution is used, it is preferred to predilute with non-autorerigerant solvents, especially ketones. Non-autorefrigerant solvent, as the term is used herein, refers to dewaxing solvents, preferably ketones, that are liquid at normal temperature and pressure, but may include the presence of as much as about 30 LV (liquid volume) % of the autorefrigerant used in the second chilling zone, based on the waxy oil feed.

The first chilling zone may be any type of chilling zone used in conventional ketone dewaxing processes described under DESCRIPTION OF THE PRIOR ART, supra, including scraped-surface chilling zones. However, in a preferred embodiment of this invention, the first chilling zone will be an incremental DILCHILL zone of the type disclosed in U.S. Pat. No. 3,773,650 discussed, supra, the disclosures of which are incorporated herein by reference. That is, a waxy oil at a temperature above its cloud point is introduced into an elongated, staged chilling zone or tower and cold, non-autorefrigerant dewaxing solvent, such as ketone, is incrementally introduced into said DILCHILL zone along a plurality of stages therein, while maintaining a high degree of agitation so as to effect substantially instantaneous mixing of the solvent and wax/oil mixture as they progress through said zone. It is also preferred to precipitate most of the wax from the oil in the first chilling zone.

The non-autorefrigerative dewaxing solent employed in the first chilling zone of this invention includes one or more (a) aliphatic ketones having from 3–6 carbon atoms, such as acetone, methyl-ethyl ketone (MEK), methyl-isobutyl ketone (MIBK), methyl-propyl ketone and mixtures thereof, (b) halogenated low molecular weight hydrocarbons such as $C_2$–$C_4$ alkyl chlorides (e.g., dichloromethane, dichloroethane, methylene chloride) and mixtures thereof, (c) normal or isoparaffins having 5 to 10 carbon atoms, (d) aromatics such as benzene, toluene, xylene, petroleum naphtha and mixtures thereof, and (e) mixtures of any of the foregoing solvents. Non-autorefrigerant solvent as herein defined may include up to 25 LV % of autorefrigerant solvent, preferably not more than 10 LV % and still more preferably not more than 5 LV % but most preferably no autorefrigerants at all. For example, the ketones are often used in combination with one or more aromatic compounds such as benzene, toluene, xylene and petroleum naphtha. Preferred solvents comprise ketones. Particularly preferred are mixtures of MEK and MIBK or MEK and toluene. Autorefrigerants used in the second chilling zone of this invention include liquid, normally gaseous $C_2$–$C_4$ hydrocarbons such as propane, propylene, ethane, ethylene and mixtures thereof as well as ammonia and normally gaseous chlorofluorocarbons such as monochlorodifluoromethane (Freon 22). Autorefrigerative solvent as herein defined may contain up to about 50 LV % of non-autorefrigerative solvent, preferably no more than 10 LV % and preferably no more than 2 LV %.

The slurry from the first chilling zone is passed directly into the top of the second chilling zone which is a vertical, multi-staged, constant pressure tower wherein the slurry is further cooled down to the wax filtration temperature and additional wax is precipitated therefrom. Liquid autorefrigerant is injected into each stage of the second chilling zone wherein it contacts the slurry and cools same via autorefrigerative evaporation. Each stage contains means for removing the autorefrigerant vapors therefrom and the slurry flows down from stage to stage in the tower by the action of gravity. The cooled slurry exiting this second chilling zone is then passed to means, such as rotary pressure filters, for separating the wax from the dewaxed oil/solvent mixture. In general, this second chilling zone or tower will operate at a constant pressure within the range of from about 0 to 50 psig and more preferably from about 2 to 20 psig. The average chilling rate in the tower is the difference between the slurry temperature entering and exiting the tower divided by the residence time of the slurry in the tower and will range from about 0.1° to 20° F./minute and more preferably from 0.5° to 10° F./minute. This is achieved by controlling the autorefrigerant flow rate into, and oil hold-up in, each stage, rather than by gradually decreasing the pressure in the system as is done in batch chillers. That is, a controlled quantity of autorefrigerant is vaporized in direct contact with a controlled quantity of slurry in each stage of the tower. This is accomplished by injecting the liquid autorefrigerant through spray nozzles either submerged in the slurry or above the surface thereof in each stage of the tower under flow rate control conditions. This in turn controls the temperature drop for each stage which will range from about 2° to 20° F. The stagewise slurry chilling rate then depends on the liquid holdup or residence time for each stage. The autorefrigerant evaporates and cools the oil primarily by its latent heat of vaporization which results in an extremely high heat transfer rate. The autorefrigerant vapor is withdrawn from each stage in a manner so as to avoid vapor overload in the tower. In a preferred embodiment, this is done by separately removing the vapor from the vapor space of each stage directly through and outside of the cooling zone or tower, rather than allowing the vapor to cumulatively pass up through each upper, successive stage, as is disclosed in the prior art. However, under certain circumstances, it may be advantageous to allow the vapor produced in one or more given stages to pass up through the tower or cooling zone through some, but not all, of the stages above said one or more given stages before removing the then cumulative vapor from the cooling zone or tower. By way of illustration, it may be advantageous to remove vapor from the zone or tower at every second, third or fourth successive stage. An amount of autorefrigerant is added per stage to give a stagewise temperature decrease ranging from 2° to 20° F., and more preferably from 3° to 10° F. Of course, the ultimate temperature to which the slurry is cooled in this tower will depend on the temperature of the slurry as it enters same, the liquid hold-up in each stage, the amount, type and temperature of autorefrigerant injected into each stage as well as the pressure in the tower and the number of stages in the tower. Therefore, it is understood, of course, depending on the feed and size of the tower, that it may not always be necessary to inject liquid autorefrigerant into each and every stage of the tower. The second cooling zone will, in general, cool the slurry down to a temperature ranging from between about 10° to 40° F. and, more preferably, 15° to 30° F. below the desired pour point of the dewaxed oils.

Any waxy petroleum oil stock or distillate fraction thereof may be dewaxed employing the process of this invention. Illustrative, but non-limiting examples of such stocks are (a) distillate fractions that have a boiling range within the broad range of 500° F. to about 1300° F., with preferred stocks including a lubricating oil and specialty oil fractions boiling within the range of between about 560° F. and 1200° F., (b) heavy feedstocks containing at least about 10 wt. % of residual material boiling above 1050° F., examples of which include bright stocks and deasphalted resids having an initial boiling point of above about 800° F. and (c) broad cut feedstocks that are produced by topping or distilling the lightest material or for crude oil leaving a broad cut oil, the major portion of which boils above about 500° F. or 650° F. Additionally, any of these feeds may be hydrocracked prior to distilling, dewaxing or topping. The distillate fractions may come from any source such as the paraffinic crudes obtained from Aramco, Kuwait, the Panhandle, North Louisiana, etc., naphthenic crudes such as Tia Juana, Coastal crudes, etc., as well as the relatively heavy feedstocks such as bright stocks having a boiling range of 1050+° F. and synthetic feedstocks derived from Athabasca Tar Sands, coal liquids, etc.

In a preferred embodiment wherein mixtures of MEK and MIBK are used as the non-autorefrigerant solvent and coolant in the first chilling zone, MEK to MIBK ratios may vary from 90% MEK/10% MIBK to 10% MEK/90% MIBK and more preferably from 70% MEK/30% MIBK to 70% MIBK/30% MEK. Ketone to oil volume ratios may vary from 0.5/1 to 10/1 and more preferably from 1.0/1 to 4/1. Predilution volume ratios of either autorefrigerant or non-autorefrigerant solvent may vary from 0/1 to 3/1 and more preferably from 0/1 to 2/1 depending on prediluent and feedstock. Chilling rates in the first chilling zone may vary from 0.1° F./min. to 20° F./min. and more preferably from 0.5° F./min. to 10° F./min. Outlet temperatures from the first chilling zone may vary from −20° F. to +90° F. and more preferably from 20° F. to 80° F. Lower outlet temperatures are better for distillate stocks while higher outlet temperatures are better for residual stocks. It is preferred that most of the wax crystallize out of the oil in the first chilling zone.

When propylene is used as the autorefrigerant in the second chilling zone, from about 0.2 to 2.5 volumes of propylene per volume of waxy oil and more preferably from about 1.0 to 2.0 volumes per volume are used, to reduce the temperature of the slurry down to the wax filtration temperature, and to reduce the viscosity of the slurry sufficiently for wax filtration. Chilling rates in the second chilling zone will generally range from about 0.1° to 20° F./min. and more preferably from about 0.5° to 10° F./min. The temperature of the cold slurry exiting the second chilling zone may vary from about −50° F. to +30° F. to produce a dewaxed oil having a pour point ranging between about −30° F. to +80° F. In a preferred embodiment, the slurry will exit the second zone at a temperature of from −30° F. to +10° F. in order to produce a dewaxed oil having a pour point ranging from between about −10° F. to +30° F.

DESCRIPTION OF A PREFERRED EMBODIMENT

Figure 1:
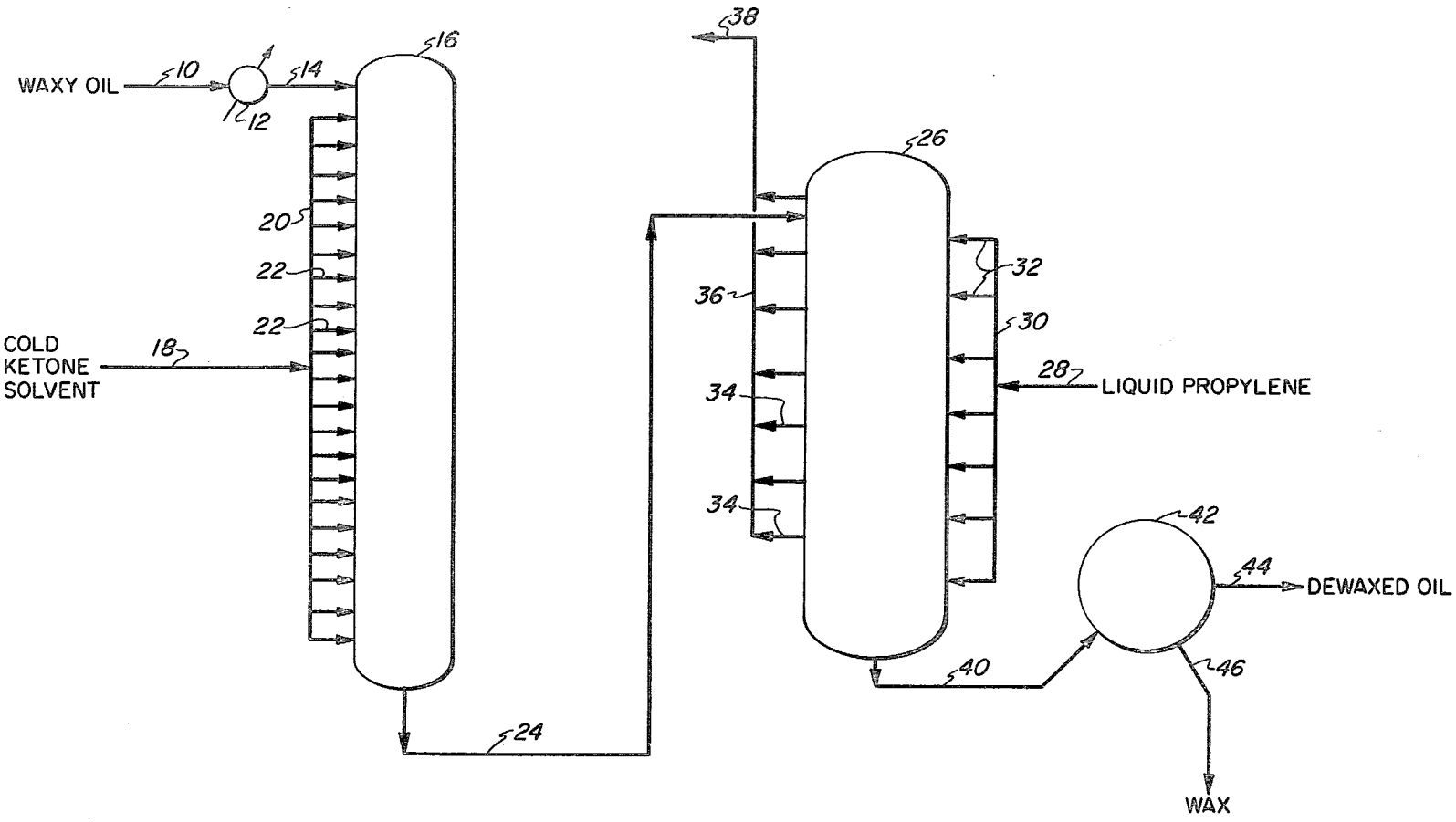
FIG. 1 is a flow diagram of a preferred embodiment of a process incorporating the instant invention.

Referring to FIG. 1, a warm paraffinic lube oil distillate at a temperature of about 160° F. and having a viscosity of 150 SUS at 100° F. is passed from line 10 through heat exchanger 12 wherein it is cooled to a temperature of about 84° F. or just above its cloud point and from there into multi-staged DILCHILL tower 16 via line 14. In tower 16 it is cooled by contact with a cold (−30° F.) ketone solvent comprising a mixture of 70% MEK/30% MIBK (volume basis) which is injected into the various stages of tower 16 via line 18, manifold 20 and multiple injection points 22. About 1.2 volumes of the cold ketone dewaxing solvent enter the tower per volume of feed. Each stage (not shown) in tower 16 contains a rotating impeller so that the cold ketone dewaxing solvent entering therein is substantially instantaneously mixed with the waxy oil. In tower 16 most of the wax is precipitated from the waxy oil producing a slurry which leaves the bottom of tower 16 via line 24 at a temperature of about 30° F. The cold, ketone-containing slurry in line 24 is passed directly into multi-staged autorefrigerant chilling tower 26. Liquid propylene at a temperature of −30° F. is fed into the various stages of tower 26 via line 28, manifold 30 and multiple injection points 32. Multiple injection points 32 are fed to each of the various stages in tower 26 wherein the liquid propylene contacts the slurry in each stage via a sparger located under the surface of the slurry in each stage. About 1.5 volumes of liquid propylene are used in tower 26 per volume of slurry entering therein via line 24. Tower 26 operates at a pressure of about 2 psig. About 0.6 volumes of the liquid autorefrigerant per volume of fresh feed evaporates upon contact with the slurry, with the autorefrigerant vapors being removed from each stage via multiple tower exit ports 34, manifold 36 and line 38 at an average temperature of about −12° F. Thus, none of the vapor produced in any stage passes through the slurry on any other stage in the tower. The remaining 0.9 volumes of propylene per volume of feed go into solution with the MEK/MIBK/ and dewaxed oil in the wax slurry. Tower 26 contains approximately seven stages in which the average slurry chilling rate is about 3° F. per minute with an average temperature drop across each stage of about 8.6° F. The waxy slurry is further cooled in tower 26 to a temperature of about −30° F. The slurry comprising solid wax particles, oil, ketone and liquid propylene is then fed to rotary pressure filter 42 via line 40 wherein the wax is filtered from the dewaxed oil solution. The dewaxed oil solution leaves filter 42 via line 44 and from there is sent to solvent recovery while the wax is removed via line 46 and sent to solvent recovery and further wax processing if desired. The dewaxed oil solution yields a dewaxed oil having a pour point of about −10° F.

Figure 2A:
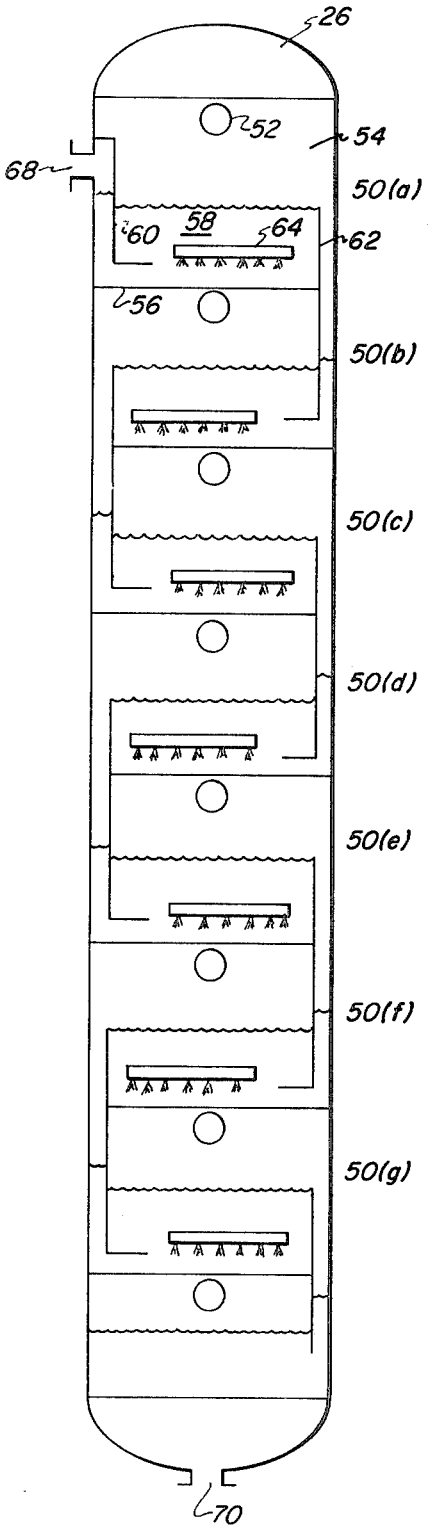
FIG. 2 is a schematic diagram of a preferred embodiment of a multi-staged, vertical tower comprising the second chilling zone of this invention.
Figure 2B:
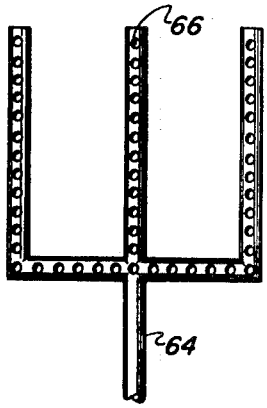
Figure 2C:
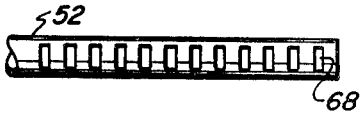

FIG. 2 (*a*) illustrates a preferred embodiment of autorefrigerant chilling tower 26. The diameter of the tower is sized so as to provide a superficial vapor velocity low enough to avoid entrainment of the oil in the vapor. The tower comprises about seven discrete stages, 50a through 50g. Each stage contains an autorefrigerant vapor collector, vapor space, slurry trays, slurry downcomer, weir and liquid autorefrigerant sparger. This is illustrated for stage 50a wherein 52 is the vapor collector, 54 represents the vapor space, 56 is the slurry tray, 58 is the slurry, 60 is the downcomer, 62 is the weir and 64 is the sparger. The sparger 64 and autorefrigerant vapor collector 52 are detailed in FIGS. 2-b and 2-c, respectively. Sparger 64 comprises piping containing a plurality of small holes 66. Vapor collector 52 is shown as a pipe containing a plurality of rectangular holes 68. In operation, slurry from tower 16 is fed to tower 26 via line 24, entering tower 26 through feed inlet 68 and passing through downcomer 60 wherein it is directed downward and under the surface of the slurry 58 held up on stage 50a. Liquid propylene is introduced into stage 50 from injection point 32 through sparger 64 and holes 66. The holes are sized so as to provide a level of agitation such that there is substantially instantaneous mixing (i.e., 1 second or less). The holes are directed downward, opposing slurry flow through the stage. Some of the propylene vaporizes as it enters the warmer slurry and the vapors bubble up through the slurry, with the remainder of the propylene going into solution. Propylene vapors are removed through vapor collector 52 and the cooled slurry flows over weir 62 wherein it enters downcomer 60 and is directed under the surface of the slurry on the next stage 50b. This process is repeated from stage to stage as the slurry passes down the tower until it exits from slurry outlet 70 at wax filtration temperature and fed to wax filter 42.

The invention will be more readily understood by reference to the following example:

EXAMPLE

This example provides laboratory data comparing the combination process of this invention with conventional DILCHILL ketone dewaxing followed by scraped surface chilling. Three paraffinic lube oil feedstocks were used, a bright stock, and two distillates having viscosities of 150 (150 N) and 600 SUS (600 N) at 100° F. A pilot plant DILCHILL unit was used for the DILCHILL dewaxing with ketone solvent to produce a ketone-containing slurry comprising solid particles of wax and a mixture of partially dewaxed oil and ketone dewaxing solvent. The temperature of the cold ketone solvent fed into the DILCHILL unit was about −30° F. The bright stock was prediluted with 1 volume of warm ketone solvent per volume of feed before being fed into the DILCHILL unit. The waxy slurry produced in the DILCHILL unit was then fed to either scraped surface chillers or to a simulated continuous, autorefrigerant chilling unit for further chilling down to wax filtration temperature. The cold slurry was then filtered to separate the wax from the dewaxed oil/solvent mixture and both the dewaxed oil and wax were recovered.

The autorefrigerant chilling unit comprised a vessel operating at a constant pressure of about 2 psig wherein liquid propylene was continuously injected into the unit, below the surface of the slurry contained therein. Part of the liquid propylene vaporized with the vapors being continuously withdrawn from the constant pressure vapor space above the slurry. A slurry chilling rate of about 2° F./min. was maintained by controlling the rate of injection of the liquid propylene into the slurry.

The results of these experiments, correlated to common dewaxed oil pour points, are contained in the Table. These results illustrate not only the operability of the present invention, but also that superior results can be achieved by its use. Thus, using the present invention gave faster feed filter rates, drier wax cakes and wax cakes containing less oil than the DILCHILL dewaxing process followed by scraped surface chilling. Further, these results were obtained without the use of dewaxing aid.

TABLE

COMBINATION DEWAXING PROCESS COMPARED TO DILCHILL FOLLOWED BY SCRAPED SURFACE CHILLING

| Process | Combination | | | DILCHILL Dewaxing Followed by Scraped Surface Chilling | | |
|---|---|---|---|---|---|---|
| Solvent | MEK/MIBK/Propylene[a] | | | MEK/MIBK | | |
| Feedstock | 150N | 600N | B.S.[b] | 150N | 600N | B.S.[b] |
| Predilution | | | | | | |
| - Solvent | — | — | MEK/MIBK | — | — | MEK/MIBK |
| - Vol. Ratio | — | — | 1.0 | — | — | 1.0 |
| MEK/MIBK Ratio | 70/30 | 70/30 | 50/50 | 50/50 | 40/60 | 15/85 |
| Cold Dilution Vol. Ratio | | | | | | |
| - MEK/MIBK | 1.2 | 1.8 | 2.4 | 2.2 | 3.3 | 3.9 |
| - Propylene | 0.9 | 1.5 | 1.5 | — | — | — |
| First Zone Outlet Temp., °F. | 30 | 35 | 77 | 29 | 25 | 53 |
| Second Zone Outlet Temp., °F. | −30 | −30 | −30 | −11[c] | −5[c] | −6[c] |
| Feed Filter Rate, GPHPSF[d] | 8.8 | 6.7 | 4.4 | 8.4 | 5.0 | 3.6 |
| DWO Pour, °F. | −10 | −4 | −4 | −10 | −4 | −4 |
| Wt. % Oil in Wax (No Wash) | 54 | 50 | 49 | 65 | 51 | 50 |
| Average Cake Liquid/Solids | 4.3 | 5.1 | 5.8 | 7.0 | 5.5 | 6.1 |

[a]Liquid propylene at a temperature of −30° F.
[b]Bright stock.
[c]Outlet temperature of slurry from scraped surface chillers following DILCHILL
[d]Gallons per hour per square foot of filter surface.

What is claimed is:

1. A continuous, combination non-autorefrigerant-/autorefrigerant solvent dewaxing process for dewaxing waxy hydrocarbon oils which comprises the steps of:

(a) passing the waxy oil into a first chilling zone wherein a portion of the wax is precipitated from the oil by cooling same in the presence of a non-autorefrigerant dewaxing solvent to form a slurry comprising an oil solvent mixture and solid particles of wax;

(b) passing said slurry from said first chilling zone to a second chilling zone which comprises a vertical, multi-staged tower operating at a constant pressure wherein each stage contains a liquid space and a vapor space above the liquid space, each of said vapor spaces also containing means for removal of autorefrigerant vapor therefrom;

(c) cooling said slurry produced in said first chilling zone down to wax filtration temperature and precipitating additional wax therefrom in said second chilling zone by contacting same in said second zone with a liquid autorefrigerant which is introduced under flow rate control conditions into a plurality of the stages in said second zone and allowed to evaporate therein so as to achieve an average cooling rate of the slurry in said zone ranging from between about 0.1° to 20° F. per minute with an average temperature drop across each stage into which said liquid autorefrigerant is introduced and evaporated ranging from between about 2° to 20° F. and wherein the evaporated autorefrigerant is removed from each of said stages into which said liquid autorefrigerant was injected in a manner such that the autorefrigerant vapor formed in any given stage does not pass through all of the stages in the tower above said stage; and (d) separating the wax from the slurry to obtain wax and a dewaxed oil solution.

2. The process of claim 1 wherein said second chilling zone operates at a constant pressure ranging from about 0 to 50 psig.

3. The process of claim 2 wherein most of said wax is precipitated from said waxy oil in said first chilling zone.

4. The process of claim 3 wherein the slurry in the second chilling zone is cooled at a rate of from about 0.1° to 20° F. per minute.

5. The process of claim 4 wherein said liquid autorefrigerant used in said second chilling zone is selected from the group consisting essentially of normally gaseous $C_2$–$C_4$ hydrocarbons, ammonia and normally gaseous fluorocarbons.

6. The process of claim 4 wherein said waxy oil is at a temperature at or above its cloud point when it enters the first chilling zone.

7. The process of claim 5 wherein said first chilling zone is a DILCHILL chilling zone.

8. The process of claim 7 wherein the waxy oil is at a temperature above its cloud point when passed into the first chilling zone.

9. The process of claim 8 wherein said non-autorefrigerant solvent used in said first chilling zone comprises one or more solvents selected from the group consisting essentially of (a) $C_3$–$C_6$ aliphatic ketones, (b) $C_2$–$C_4$ alkyl chlorides and (c) mixtures of $C_3$–$C_6$ aliphatic ketones with one or more aromatic compounds including benzene, toluene, xylene and petroleum naphtha.

10. The process of claim 8 wherein said non-autorefrigerative solvent comprises one or more $C_3$–$C_6$ aliphatic ketones mixed with one or more aromatic compounds selected from the group consisting essentially of benzene, toluene, xylene, petroleum naphtha and mixture thereof.

11. The process of claim 10 wherein no more than 30 LV % of autorefrigerant, based on said waxy oil feed, is present in said first chilling zone.

12. The process of claim 11 wherein no autorefrigerant is present in said first chilling zone.

13. A continuous, combination non-autorefrigerant-/autorefrigerant process for solvent dewaxing waxy petroleum oil fractions which comprises the steps of:

(a) passing said waxy petroleum oil fraction at a temperature above its cloud point into a DILCHILL dewaxing zone comprising an elongated chilling zone divided into a plurality of stages and passing said waxy oil from stage to stage of said zone while injecting cold ketone dewaxing solvent into at least a portion of said stages and maintaining a high degree of agitation in a plurality of the ketone dewaxing solvent-containing stages so as to achieve substantially instantaneous mixing of said waxy oil and said solvent-waxy oil mixture as it progresses from stage to stage through said chilling zone to precipitate a portion of wax from said oil under conditions of said high degree of agitation to form a first slurry of oil, solvent and solid particles of wax;

(b) passing said first slurry from the DILCHILL dewaxing zone to the top of a second chilling zone which comprises a vertical, multi-staged tower operating at a constant pressure ranging between about 0 to 50 psig wherein each stage contains a liquid space, a vapor space above the liquid space and means for removing autorefrigerant vapor from each vapor space;

(c) cooling said first slurry down to wax filtration temperature and precipitating additional wax therefrom by contacting said slurry in said second zone with a liquid autorefrigerant which is introduced under flow rate control conditions into a plurality of the stages in said second zone and allowed to evaporate therein at a controlled rate so as to achieve an average cooling rate of the slurry in said second zone ranging from between about 0.1° to 20° F./minute with an average temperature drop across each stage into which said liquid autorefrigerant is introduced into and evaporated in ranging from between about 2° to 20° F. and wherein the evaporated autorefrigerant is removed from each of said stages into which said liquid autorefrigerant was injected in a manner such that the autorefrigerant vapor formed in any given stage does not pass through all of the stages in said zone above said stage; and (d) filtering the wax from the slurry to obtain wax in a dewaxed oil solution.

14. The process of claim 13 wherein the ketone dewaxing solvent is selected from the group consisting of (a) ketones having from 3 to 6 carbon atoms in the molecule and mixture thereof and (b) a mixture of 3 to 6 carbon atom ketones and aromatic compounds.

15. The process of claim 14 wherein the liquid autorefrigerant injected into the second chilling zone is selected from the group consisting of from 2 to 4 carbon atom hydrocarbons, ammonia and normally gaseous chlorofluorocarbons.

16. The process of claim 15 wherein the ketone dewaxing solvent is a mixture of MEK/MIBK or MEK/-toluene and the autorefrigerant is propylene.

17. A continuous, combination ketone/autorefrigerant process for solvent dewaxing wax-containing heavy petroleum oil fractions which contain at least about 10 wt. % of residual material having an initial boiling point of about 1050° F. which comprises the steps of:

(a) mixing said oil with a predilution solvent;

(b) introducing said mixture into a DILCHILL dewaxing zone and passing said mixture from stage to stage of said zone while injecting cold ketone dewaxing solvent into at least a portion of said stages and maintaining a high degree of agitation in a plurality of the solvent-containing stages so as to achieve substantially instantaneous mixing of said ketone dewaxing solvent and said waxy oil/solvent mixture as it progresses from stage to stage through said chilling zone, thereby precipitating most of the wax from the oil to form a first slurry of oil, solvent and solid particles of wax;

(c) passing said first slurry from the DILCHILL dewaxing zone to the top of a second chilling zone which comprises a vertical, multi-staged tower operating at a constant pressure ranging from between about 0 to 50 psig wherein each stage contains a liquid space, a vapor space above the liquid space and means for moving autorefrigerant vapor from each vapor space;

(d) cooling the first slurry down to wax filtration temperature and precipitating additional wax therefrom by contacting said slurry in said second zone with a liquid autorefrigerant which is introduced under flow rate control conditions into a plurality of the stages in said second zone and allowed to evaporate therein at a controlled rate so as to achieve an average cooling rate of the slurry in said second zone ranging from between about 0.1° to 20° F./minute and wherein the evaporated autorefrigerant is removed from each of said stages into which said liquid autorefrigerant was injected in a manner such that the autorefrigerant vapor found in any given stage does not pass through all of the stages in said zone above said stage; and (e) filtering the wax from the slurry to obtain wax in a dewaxed oil solution.

* * * * *

UNITED STATES PATENT OFFICE

CERTIFICATE OF CORRECTION

Patent No. 4,216,075 Dated August 5, 1980

Inventor(s) Douglas G. Ryan

It is certified that error appears in the above-identified patent and that said Letters Patent are hereby corrected as shown below:

On the cover page insert:

-- [73] Assignee: Exxon Research and Engineering Company, Florham Park, New Jersey --.

Signed and Sealed this

Ninth Day of December 1980

[SEAL]

Attest:

SIDNEY A. DIAMOND

Attesting Officer

Commissioner of Patents and Trademarks